US010018932B1

(12) United States Patent
Ojima

(10) Patent No.: US 10,018,932 B1
(45) Date of Patent: Jul. 10, 2018

(54) ELECTROSTATIC LATENT IMAGE DEVELOPING TONER

(71) Applicant: KYOCERA Document Solutions Inc., Osaka (JP)

(72) Inventor: Seishi Ojima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/561,997

(22) PCT Filed: Sep. 28, 2016

(86) PCT No.: PCT/JP2016/078651
§ 371 (c)(1),
(2) Date: Sep. 27, 2017

(87) PCT Pub. No.: WO2017/057475
PCT Pub. Date: Apr. 6, 2017

(30) Foreign Application Priority Data

Oct. 1, 2015 (JP) ..... 2015-196019

(51) Int. Cl.
*G03G 9/093* (2006.01)

(52) U.S. Cl.
CPC ..... *G03G 9/09321* (2013.01); *G03G 9/09371* (2013.01)

(58) Field of Classification Search
CPC . G03G 9/093; G03G 9/09307; G03G 9/09321
See application file for complete search history.

(56) References Cited

U.S. PATENT DOCUMENTS

2013/0183618 A1* 7/2013 Takagi ..... G03G 9/09321 430/110.2

FOREIGN PATENT DOCUMENTS

JP 2009-014757 A 1/2009

* cited by examiner

*Primary Examiner* — Peter L Vajda
(74) *Attorney, Agent, or Firm* — Studebaker & Brackett PC

(57) ABSTRACT

An electrostatic latent image developing toner includes toner particles each including a toner core (11) and a shell layer (12) disposed over a surface of the toner core (11). The toner core (11) contains a polyester resin. The shell layer (12) includes: first resin particles (12*a*) having a number average primary particle diameter of at least 30 nm and less than 70 nm and a glass transition point of less than 80° C.; and second resin particles (12*b*) having a number average primary particle diameter of 70-200 nm and a glass transition point of at least 80° C. A percentage of an area of the toner core (11) covered with the first resin particles (12*a*) relative to a surface area of the toner core (11) is 40-80%. A ratio of total mass of the second resin particles (12*b*) to total mass of the first resin particles (12*a*) is 0.5-2.0.

4 Claims, 2 Drawing Sheets

ELECTROSTATIC LATENT IMAGE DEVELOPING TONER

TECHNICAL FIELD

The present invention relates to an electrostatic latent image developing toner, and more particularly relates to a capsule toner.

BACKGROUND ART

Toner particles included in a capsule toner each include a core and a shell layer (capsule layer) disposed over a surface of the core. The shell layers covering the cores can improve high-temperature preservability of the toner. The toner particles described in Patent Literature 1 each have a shell layer (a coat layer) formed from fine resin particles containing a non-crystalline polyester resin.

CITATION LIST

Patent Literature

[Patent Literature 1]
Japanese Patent Application Laid-Open Publication No. 2009-14757

SUMMARY OF INVENTION

Technical Problem

However, it is difficult for the technique disclosed in Patent Literature 1 by itself to provide an electrostatic latent image developing toner that is excellent in high-temperature preservability and low-temperature fixability and that is capable of continuously forming images each having almost the same image density in a stable manner when used in continuous printing.

The present invention was achieved in consideration of the above problem and an object thereof is to provide an electrostatic latent image developing toner that is excellent in high-temperature preservability and low-temperature fixability and that is capable of continuously forming images each having almost the same image density in a stable manner when used in continuous printing.

Solution to Problem

An electrostatic latent image developing toner according to the present invention includes a plurality of toner particles each including a core and a shell layer disposed over a surface of the core. The core contains a polyester resin. The shell layer includes: a plurality of first resin particles having a number average primary particle diameter of at least 30 nm and less than 70 nm and a glass transition point of less than 80° C.; and a plurality of second resin particles having a number average primary particle diameter of at least 70 nm and no greater than 200 nm and a glass transition point of at least 80° C. A percentage of an area of the core that is covered with the first resin particles relative to a surface area of the core is at least 40% and no greater than 80%. A ratio of a total mass of the plurality of second resin particles to a total mass of the plurality of first resin particles is at least 0.5 and no greater than 2.0.

Advantageous Effects of Invention

The present invention can provide an electrostatic latent image developing toner that is excellent in high-temperature preservability and low-temperature fixability and that is capable of continuously forming images each having almost the same image density in a stable manner when used in continuous printing.

DESCRIPTION OF EMBODIMENTS

Figure 1:
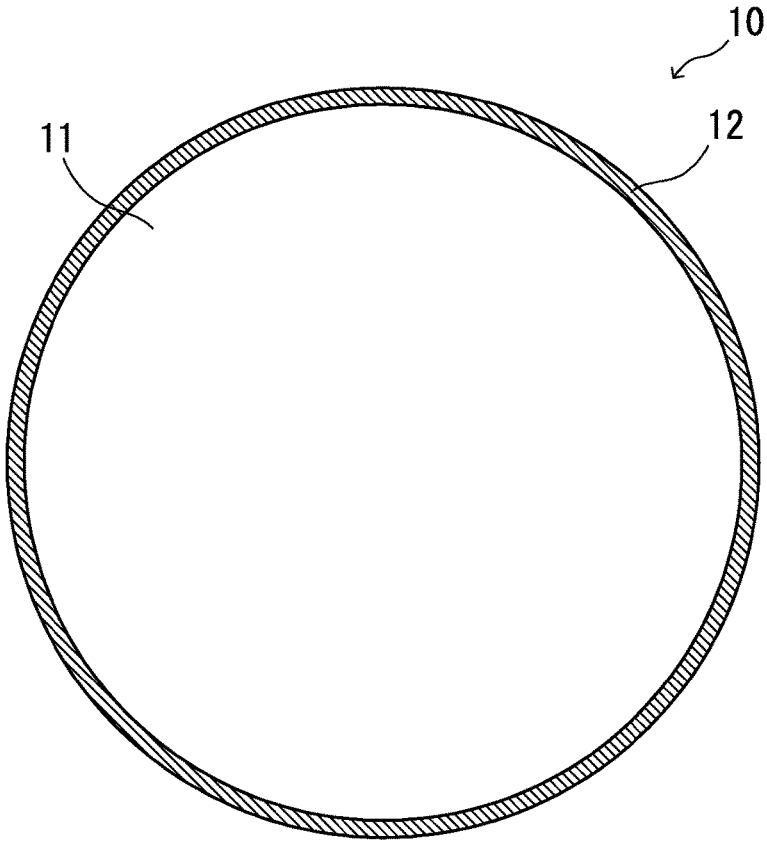
FIG. 1 is a diagram illustrating an example of a cross-sectional structure of a toner particle (in particular, a toner mother particle) included in an electrostatic latent image developing toner according to an embodiment of the present invention.

An embodiment of the present invention will be described in detail. Note that unless otherwise stated, results (for example, values indicating shapes or properties) of evaluations that are performed on a powder (specific examples include toner cores, toner mother particles, an external additive, or a toner) are each a number average of values measured for a suitable number of particles.

A number average particle diameter of a powder is a number average of equivalent circle diameters of primary particles (diameters of circles having the same area as projections of the particles) measured using a microscope, unless otherwise stated. A value for volume median diameter ($D_{50}$) of a powder was measured using "Coulter Counter Multisizer 3", product of Beckman Coulter, Inc., unless otherwise stated. A value for roundness (=perimeter of a circle having the same area as the projection area of the particle/perimeter of the real particle) is a number average of values measured for a suitable number of particles (for example, 3,000 particles) using a flow particle imaging analyzer ("FPIA (registered Japanese trademark)-3000", product of Sysmex Corporation), unless otherwise stated.

Acid values and hydroxyl values were measured in accordance with "Japanese Industrial Standard (JIS) K0070-1992", unless otherwise stated. Values for number average molecular weight (Mn) and mass average molecular weight (Mw) were measured by gel permeation chromatography, unless otherwise stated. SP values are calculated in accordance with the Fedors estimation method (R. F. Fedors, "Polymer Engineering and Science", 14 (2), p 147-154 (1974)), unless otherwise stated. An SP value is represented by the formula "SP value=$(E/V)^{1/2}$" (E: molecular cohesive energy [cal/mol], V: molecular volume [$cm^3$/mol]).

Chargeability refers to chargeability in triboelectric charging, unless otherwise stated. Strength of a positively chargeable character (or a negatively chargeable character) in triboelectric charging can be confirmed by for example a known triboelectric series.

Hereinafter, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth) acryloyl" is used as a generic term for both acryloyl ($CH_2$═CH—CO—) and methacryloyl ($CH_2$═C($CH_3$)—CO—).

The toner according to the present embodiment can for example be suitably used for development of an electrostatic latent image as a positively chargeable toner. The toner according to the present embodiment is a powder including a plurality of toner particles (particles each having the later-described feature). The toner may be used as a one-component developer. Alternatively, the toner may be mixed with a carrier using a mixer (specific examples include a ball mill) in order to prepare a two-component developer. In order to achieve high quality image formation, a ferrite carrier (a powder of ferrite particles) is preferably used as the carrier. In order to achieve high quality image formation over an extended period of time, magnetic carrier particles including carrier cores and resin layers coating the carrier cores are preferably used. In order that carrier particles are magnetic, carrier cores thereof may be formed from a magnetic material (for example, a ferromagnetic material such as ferrite) or formed from a resin in which magnetic particles are dispersed. Alternatively, magnetic particles may be dispersed in the resin layers coating the carrier cores. Preferably, in order to achieve high quality image formation, an amount of the toner in the two-component developer is at least 5 parts by mass and no greater than 15 parts by mass relative to 100 parts by mass of the carrier. Note that a positively chargeable toner included in a two-component developer is positively charged by friction against a carrier therein.

The toner particles included in the toner according to the present embodiment each include a core (hereinafter, referred to as a toner core) and a shell layer (capsule layer) disposed over a surface of the toner core. The toner cores contain a binder resin. The toner cores may further contain internal additives (for example, a colorant, a releasing agent, a charge control agent, and a magnetic powder). An external additive may adhere to a surface of the shell layer (or a region of the surface of the toner core that is not covered with the shell layer). The external additive may be omitted if unnecessary. Hereinafter, the term toner mother particles is used to refer to toner particles that are yet to be subjected to external additive addition.

The toner according to the present embodiment can for example be used in image formation in an electrophotographic apparatus (image forming apparatus). The following describes an example of image forming methods that are performed by electrophotographic apparatuses.

First, an image forming section (a charger and a light exposure device) of an electrophotographic apparatus forms an electrostatic latent image on a photosensitive member (for example, on a surface of a photosensitive drum) based on image data. Next, a developing device (more specifically, a developing device having a toner-containing developer loaded therein) of the electrophotographic apparatus supplies the toner to the photosensitive member to develop the electrostatic latent image formed on the photosensitive member. The toner is charged by friction with the carrier or a blade in the developing device before being supplied to the photosensitive member. For example, a positively chargeable toner is positively charged. In the developing step, the toner (more specifically, the charged toner) on a development sleeve (for example, a surface of a development roller in the developing device) disposed in the vicinity of the photosensitive member is supplied to the photosensitive member, and the toner supplied is caused to adhere to the electrostatic latent image, so that a toner image is formed on the photosensitive member. Toner is supplied to the developing device from a toner container containing toner for replenishment use to make up for consumed toner.

Subsequently, in a transfer step, a transfer device of the electrophotographic apparatus transfers the toner image from the photosensitive member onto an intermediate transfer member (for example, a transfer belt), and then further transfers the toner image from the intermediate transfer member onto a recording medium (for example, paper). Next, a fixing device (fixing method: nip fixing using a heating roller and a pressure roller) of the electrophotographic apparatus fixes the toner to the recording medium by applying heat and pressure to the toner. Through the above, an image is formed on the recording medium. A full-color image can for example be formed by superimposing toner images of four colors: black, yellow, magenta, and cyan. A direct transfer process may alternatively be employed, which involves direct transfer of the toner image from the photosensitive member to the recording medium without the use of the intermediate transfer member. The fixing method may be belt fixing.

The toner according to the present embodiment is an electrostatic latent image developing toner having the following feature (hereinafter, referred to as a basic feature).

(Basic Feature of Toner)

The electrostatic latent image developing toner includes a plurality of toner particles each including a toner core and a shell layer. The toner core contains a polyester resin. The shell layer includes: a plurality of first resin particles having a number average primary particle diameter of at least 30 nm and less than 70 nm and a glass transition point of less than 80° C.; and a plurality of second resin particles having a number average primary particle diameter of at least 70 nm and no greater than 200 nm and a glass transition point of at least 80° C. A percentage (hereinafter, referred to as a first shell coverage) of an area (hereinafter, referred to as a first shell-covered area) of the toner core that is covered with the first resin particles relative to a surface area of the toner core is at least 40% and no greater than 80%. A ratio of the total mass of the plurality of second resin particles to the total mass of the plurality of first resin particles (hereinafter, referred to as a second/first shell ratio) is at least 0.5 and no greater than 2.0.

The number average primary particle diameter of the first resin particles and the number average primary particle diameter of the second resin particles are each a number average of equivalent circle diameters of primary particles (diameters of circles having the same area as projections of the particles) measured using a microscope. In a situation in which resin particles are formed in a liquid containing a surfactant, the number average primary particle diameter of the resin particles can be adjusted by adjusting the amount of the surfactant. The particle diameter of the resulting resin particles tends to decrease with an increase in the amount of the surfactant.

The glass transition point (Tg) of the first resin particles and the glass transition point (Tg) of the second resin particles are measured by a method to be described for Examples or by an alternative method. Tg of a resin can be adjusted by adjusting the type or the amount (blending ratio) of components (monomers) of the resin. For example, Tg of a styrene-(meth)acrylic acid resin can be adjusted by adjusting the blending ratio of styrene and a (meth)acrylic acid ester. Tg of the styrene-(meth)acrylic acid resin is readily adjusted by using two or more (meth)acrylic acid esters.

The first shell coverage is represented by a formula "First shell coverage (unit: %)=100×First shell-covered area/Surface area of toner core". A first shell coverage of 100% means that the surface area of each toner core is entirely covered with the first resin particles. The first shell coverage may be measured before addition of the second resin particles or after addition of the second resin particles. The toner particles having the first resin particles and the second resin particles may be used as a measurement target, and a coverage only by the first resin particles (a first shell coverage) may be determined by distinguishing the first resin particles from the second resin particles and excluding the second resin particles. Alternatively, after the second resin particles have been added, the first shell coverage may be measured by removing the second resin particles from the toner particles.

The second/first shell ratio is represented by a formula "Second/first shell ratio =(Total mass of second resin particles)/(Total mass of first resin particles)". The second/first shell ratio is obtained by dividing a sum of the masses (total mass) of all the second resin particles included in the shell layers by a sum of the masses (total mass) of all the first resin particles included in the shell layers.

According to the above-described basic feature, the first shell coverage is at least 40% and no greater than 80%. This is effective for achieving both high-temperature preservability and low-temperature fixability of the toner. A too low first shell coverage tends to lead to poor high-temperature preservability of the toner. A too high first shell coverage tends to lead to poor low-temperature fixability of the toner. The polyester resin is of strong negatively chargeable character. Thus, the toner cores containing a polyester resin tend to be negatively chargeable. However, the toner having the above-described feature has a first shell coverage of at least 40%, and therefore the toner cores are not exposed too much, allowing the toner to be positively charged in a stable manner even if the toner cores contain a polyester resin. According to the above-described basic feature, the first resin particles have a glass transition point (Tg) of less than 80° C. This makes it easy to ensure that the toner has sufficient low-temperature fixability.

According to the above-described basic feature, the first resin particles have a number average primary particle diameter of at least 30 nm and less than 70 nm. The first resin particles having a number average primary particle diameter of at least 30 nm tend to be present on the surfaces of the toner cores in a stable manner. The first resin particles having a too small number average primary particle diameter are unstable and tend to aggregate together to form larger particles. Furthermore, low-temperature fixability of the toner is readily improved by covering the toner cores with the first resin particles having a number average primary particle diameter of less than 70 nm. If the first resin particles having a number average primary particle diameter of 70 nm or greater are used to cover the toner particles, a great amount of the first resin particles are needed in order to ensure sufficient first shell coverage. Furthermore, if a great amount of the first resin particles are used to cover the toner cores, the toner tends to have poor low-temperature fixability.

According to the above-described basic feature, the shell layers each include the second resin particles in addition to the first resin particles. The second resin particles have a higher glass transition point than the first resin particles and a greater number average primary particle diameter than the first resin particles. As a result of the shell layers including the second resin particles, the toner is likely to have sufficient high-temperature preservability. The inventor has found that the second resin particles reduce attachment of the toner to a development sleeve and a photosensitive drum. Reduction of such toner attachment allows improvement in developing properties and transferability of the toner.

According to the above-described basic feature, the second/first shell ratio is at least 0.5 and no greater than 2.0, and thereby the second resin particles produce the above-described effect. If the amount of the second resin particles is too small relative to the amount of the first resin particles, the toner tends to have poor high-temperature preservability, poor developing properties, and poor transferability. If the amount of the second resin particles is too large relative to the amount of the first resin particles, the toner tends to have poor low-temperature fixability.

According to the above-described basic feature, the second resin particles have a number average primary particle diameter of at least 70 nm and no greater than 200 nm, and thereby the second resin particles produce the above-described effect. If the second resin particles have a too small number average primary particle diameter, the second resin particles tend to be easily embedded in the surfaces of the toner particles. Furthermore, if the second resin particles have a too small number average primary particle diameter, the resulting toner tends to easily adhere to a development sleeve, a photosensitive drum, and the like. The reason for the above is thought to be that fine projections and recesses tend to be formed in the surfaces of the toner particles. If the second resin particles have a too large number average primary particle diameter, the second resin particles tend to easily detach from the toner particles.

According to the above-described basic feature, the second resin particles have a glass transition point (Tg) of at least 80° C., and thereby the second resin particles produce the above-described effect. If the second resin particles have a too low Tg, the resulting toner tends to easily adhere to a development sleeve, a photosensitive drum, and the like. The reason for the above is thought to be that such second resin particles are easily deformable.

In order to improve positive chargeability and low-temperature fixability of the toner, it is preferable that the first resin particles are substantially composed of a styrene-acrylic acid-based resin. The styrene-acrylic acid-based resin has excellent positive chargeability and good compatibility with the polyester resin (the binder resin of the toner cores). In a situation in which the first resin particles are substantially composed of a styrene-acrylic acid-based resin, the requirements (Tg, particle diameter, and coverage) specified as the above-described feature are easily satisfied. The styrene-acrylic acid-based resin is also suitable as a material of the second resin particles. The styrene-acrylic acid-based resin tends to be of stronger hydrophobic character and more positively chargeable than the polyester resin.

In order to ensure sufficient low-temperature fixability of the toner more reliably, the above-described basic feature preferably requires that the first resin particles have a glass transition point of at least 60° C. In order to ensure sufficient low-temperature fixability of the toner more reliably, the above-described basic feature preferably requires that the second resin particles have a glass transition point of no greater than 150° C. In order to ensure sufficient low-temperature fixability of the toner more reliably, the above-described basic feature preferably requires that the first resin particles have a number average primary particle diameter of less than 50 nm. In order to prevent embedding of the second resin particles more reliably, the above-described basic feature preferably requires that the second resin particles have a number average primary particle diameter of at least 150 nm. The second resin particles having a number average primary particle diameter of at least 150 nm tend to function as a spacer between the toner particles and inhibit aggregation of the toner particles.

Figure 2:
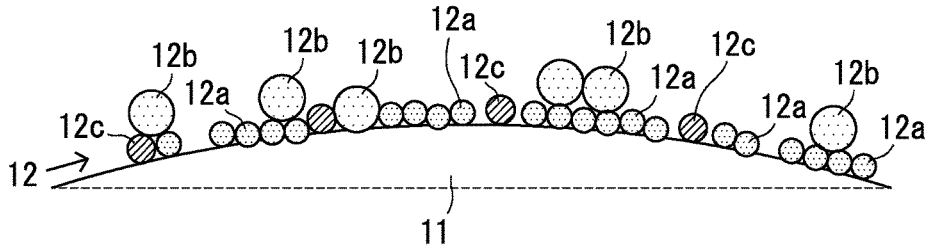
FIG. 2 is an enlarged view of a portion of a surface of the toner mother particle illustrated in FIG. 1.

In order to obtain a toner that is excellent in high-temperature preservability, low-temperature fixability, and positive chargeability, the above-described basic feature preferably requires that neither the first resin particles nor the second resin particles contain a charge control agent, and the shell layers further contain third resin particles containing a charge control agent. The following describes an example of the composition of the toner particles having the shell layers in which such first resin particles, second resin particles, and third resin particles are present, with reference to FIGS. 1 and 2. FIG. 1 is a diagram illustrating an example of the composition of a toner particle (in particular, a toner mother particle) included in the toner according to the present embodiment. FIG. 2 is an enlarged view of a portion of the toner mother particle illustrated in FIG. 1.

A toner mother particle 10 illustrated in FIG. 1 includes a toner core 11 containing a polyester resin (a binder resin) and a shell layer 12 disposed over a surface of the toner core 11. The toner core 11 is for example a ground core described below. The shell layer 12 covers the surface of the toner core 11.

As illustrated in FIG. 2, the shell layer 12 of the toner mother particle 10 includes a plurality of first resin particles 12*a*, a plurality of second resin particles 12*b*, and a plurality of third resin particles 12*c*. Neither the first resin particles 12*a* nor the second resin particles 12*b* contain a charge control agent. The third resin particles 12*c* contain a charge control agent (for example, a quaternary ammonium salt).

In the example illustrated in FIG. 2, the plurality of first resin particles 12*a* and the plurality of second resin particles 12*b* are stacked in the following order: the toner core 11, the first resin particles 12*a*, and the second resin particles 12*b*. That is, the first resin particles 12*a* are located closer to the toner core 11 than the second resin particles 12*b*. The shell layer 12 has a first resin layer including the plurality of first resin particles 12*a* and the plurality of third resin particles 12*c*, and a second resin layer including the plurality of second resin particles 12*b*. The first resin layer and the second resin layer are stacked in the following order: the toner core 11, the first resin layer, and the second resin layer. That is, the first resin particles 12*a* and the third resin particles 12*c* are located closer to the toner core 11 than the second resin particles 12*b*. The first resin particles 12*a* and the third resin particles 12*c* adhere to the surface of the toner core 11. The second resin particles 12*b* adhere to surfaces of the first resin particles 12*a* or the third resin particles 12*c*. However, the second resin particles 12*b* may adhere to the surface of the toner core 11 in a region of the surface of the toner core 11 where neither the first resin particles 12*a* nor the third resin particles 12*c* are present. The first resin particles 12*a* are for example fusion bonded to the polyester resin (the binder resin) on the surface of the toner core 11. The second resin particles 12*b* on the first resin particles 12*a* for example adhere to the first resin particles 12*a* mainly by Van der Waals forces. The second resin particles 12*b* on the third resin particles 12*c* for example adhere to the third resin particles 12*c* mainly by Van der Waals forces.

The toner according to the present embodiment includes a plurality of toner particles specified by the above-described basic feature (hereinafter, referred to as toner particles according to the present embodiment). The toner including the toner particles according to the present embodiment is thought to be excellent in high-temperature preservability and low-temperature fixability, and capable of continuously forming images each having almost the same image density in a stable manner when used in continuous printing (see Tables 1 to 3 described below). In order to obtain such effects, the toner preferably includes at least 80% by number of the toner particles according to the present embodiment, more preferably includes at least 90% by number of the toner particles according to the present embodiment, and still more preferably includes 100% by number of the toner particles according to the present embodiment. The toner may include toner particles having no shell layers in addition to the toner particles according to the present embodiment.

The toner cores prepared by a dry process tend to be compatible with the shell layers specified by the above-described basic feature. Ground cores obtained by a pulverization method are particularly compatible toner cores. The pulverization method involves a step of melt-kneading a plurality of materials (for example, resins) to obtain a kneaded product and a step of pulverizing the kneaded product to yield a powder (for example, toner cores). It is known in the art to which the present invention belongs that toner cores are broadly classified as being either ground cores (referred to also as a ground toner) or polymerized cores (referred to also as a polymerized toner).

In order to obtain a toner that is excellent in both high-temperature preservability and low-temperature fixability by forming the above-described layer structures (lower layer: the first resin particles, upper layer: the second resin particles) on the surfaces of the ground cores, it is particularly preferable that in the toner having the above-described basic feature, the polyester resin contained in the toner cores (ground cores) has a glass transition point of no greater than 50° C., the first resin particles have a glass transition point of at least 65° C., the first resin particles are fusion bonded to the polyester resin on the surfaces of the toner cores, and the second resin particles on the first resin particles adhere to the first resin particles mainly by Van der Waals forces. The first resin particles can for example be fixed to the surfaces of the toner cores by preparing and maintaining a pH adjusted dispersion containing the first resin particles and the toner cores at high temperature to melt only the toner cores (more specifically, the polyester resin present in the surfaces of the toner cores), rather than both the first resin particles and the toner cores, in the liquid, and subsequently cooling the liquid to cause solidification of the melted polyester resin. The first resin particles are fusion bonded to the polyester resin on the surfaces of the toner cores. The second resin particles can for example be caused to adhere to the surfaces of the first resin particles by mechanical impact force using a mixer (stirring device) equipped with a stirring impeller. The second resin particles adhere to the surfaces of the first resin particles by physical force (mainly by Van der Waals forces). The Van der Waals forces that contributes to the bonding between the first resin particles and the second resin particles tends to increase with an increase in surface viscosity of the first resin particles and surface viscosity of the second resin particles.

In order to obtain a toner that is excellent in both high-temperature preservability and low-temperature fixability by forming the above-described layer structures (lower layer: the first resin layer including the first resin particles and the third resin particles, upper layer: the second resin layer including the second resin particles) on the surfaces of the ground cores, it is particularly preferable that in the toner having the above-described feature, the polyester resin contained in the toner cores (ground cores) has a glass transition point of no greater than 50° C., the first resin particles have a glass transition point of at least 65° C., the third resin particles have a glass transition point of at least 65° C., the first resin particles and the third resin particles are fusion bonded to the polyester resin on the surfaces of the toner cores, the second resin particles on the first resin particles adhere to the first resin particles mainly by Van der Waals forces, and the second resin particles on the third resin particles adhere to the third resin particles mainly by Van der Waals forces.

In order to achieve high quality image formation using the toner, the toner preferably has a roundness of at least 0.950 and less than 0.985.

In order to achieve both high-temperature preservability and low-temperature fixability of the toner, the toner preferably has a volume median diameter ($D_{50}$) of at least 1 μm and less than 10 μm.

The following describes a material for formation of the toner cores and a material for formation of the shell layers (hereinafter, referred to as a shell material). Resins suitable for formation of the toner cores and the shell layers are as follows.

<Preferable Thermoplastic Resins>

Examples of thermoplastic resins that can be preferably used to form the toner particles (particularly, the toner cores or the shell layers) include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohol, vinyl ether resins, N-vinyl resins, polyester resins, polyamide resins, and urethane resins. Furthermore, copolymers of the resins listed above, that is, copolymers obtained through incorporation of a repeating unit into any of the resins listed above (specific examples include styrene-acrylic acid-based resins and styrene-butadiene-based resins) may be preferably used as the thermoplastic resin for forming the toner particles.

A styrene-acrylic acid-based resin is a copolymer of at least one styrene-based monomer and at least one acrylic acid-based monomer. For example, styrene-based monomers and acrylic acid-based monomers shown below can be preferably used for synthesizing the styrene-acrylic acid-based resin. A carboxyl group can be introduced into the styrene-acrylic acid-based resin by using an acrylic acid-based monomer having a carboxyl group. A hydroxyl group can be introduced into the styrene-acrylic acid-based resin by using a monomer having a hydroxyl group (specific examples include p-hydroxy styrene, m-hydroxy styrene, and hydroxyalkyl (meth)acrylates.

Examples of preferable styrene-based monomers include styrene, alkyl styrene (specific examples include α-methylstyrene, p-ethylstyrene, and 4-tert-butylstyrene), p-hydroxystyrene, m-hydroxystyrene, vinyltoluene, α-chlorostyrene, o-chlorostyrene, m-chlorostyrene, and p-chlorostyrene.

Examples of preferable acrylic acid-based monomers include (meth)acrylic acid, alkyl (meth)acrylates, and hydroxyalkyl (meth)acrylates. Examples of preferable alkyl (meth)acrylates include methyl (meth)acrylate, ethyl (meth) acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth)acrylate.

A polyester resin can be obtained through condensation polymerization of at least one polyhydric alcohol and at least one polycarboxylic acid. Examples of alcohols that can be preferably used in synthesis of the polyester resin include dihydric alcohols (specific examples include diols and bisphenols) and tri- or higher-hydric alcohols shown below. Examples of carboxylic acids that can be preferably used in synthesis of the polyester resin include di-, tri-, and higher-basic carboxylic acids shown below.

Examples of preferable diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The following describes, in order, the toner cores (a binder resin and internal additives), the shell layers, and external additives. Non-essential components (for example, an internal additive or an external additive) may be omitted in accordance with the intended use of the toner.

[Toner Core]

(Binder Resin)

Typically, the binder resin is a main component (for example, at least 85% by mass) of the toner cores. Accordingly, properties of the binder resin are thought to have a great influence on overall properties of the toner cores. Properties (specific examples include hydroxyl value, acid value, Tg, and Tm) of the binder resin can be adjusted by using different resins in combination for the binder resin. For example, the toner cores have a higher tendency to be anionic in a situation in which the binder resin has an ester group, a hydroxyl group, an ether group, an acid group, or a methyl group, and have a higher tendency to be cationic in a situation in which the binder resin has an amino group or an amide group. In order that the binder resin has high anionic strength, the binder resin preferably has a hydroxyl value and an acid value that are each at least 10 mg KOH/g.

The binder resin is preferably a resin that has at least one functional group selected from the group consisting of an ester group, a hydroxyl group, an ether group, an acid group, and a methyl group. A binder resin having such functional groups tends to strongly bond to the shell material. The toner cores containing such a binder resin tend to strongly bond to the shell layers. Furthermore, a resin having an activated hydrogen-containing functional group in molecules thereof is also preferable as the binder resin.

In order to improve fixability of the toner during high speed fixing, the binder resin preferably has a glass transition point (Tg) of at least 20° C. and no greater than 55° C. In order to improve fixability of the toner during high speed fixing, the binder resin preferably has a softening point (Tm) of no greater than 100° C. Tg and Tm are measured by methods to be described for Examples or by alternative methods. Either or both of Tg and Tm of a resin can be adjusted by changing the type or the amount of components (monomers) of the resin.

In order that the first resin particles are fusion bonded to the polyester resin on the surfaces of the toner cores, the polyester resin contained in the toner cores preferably has a glass transition point of no greater than 50° C., and the first resin particles preferably have a glass transition point of at least 65° C. The first resin particles are readily fixed to the surfaces of the toner cores by melting only the polyester resin (binder resin), rather than both the polyester resin and the first resin particles, and causing solidification of the melted polyester resin. In order to inhibit excessive melting of the polyester resin (the binder resin), the polyester resin contained in the toner cores preferably has a glass transition point of at least 40° C.

The toner according to the present embodiment has the above-described basic feature. The toner cores in the toner according to the present embodiment contain at least one polyester resin. The toner cores may contain only a polyester resin as the binder resin or may contain a resin other than the polyester resin (specific examples include those mentioned in "Preferable Thermoplastic Resins") as the binder resin. In order to improve colorant dispersibility in the toner, chargeability of the toner, and fixability of the toner to a recording medium, it is preferable to use either a styrene-acrylic acid-based resin or a polyester resin as the binder resin. In order to obtain a toner that is excellent in low-temperature fixability, the polyester resin preferably accounts for at least 80% by mass of the resin contained in the toner cores, more preferably the polyester resin accounts for at least 90% by mass of the resin, and still more preferably the polyester resin accounts for 100% by mass of the resin.

In a situation in which the polyester resin is used as the binder resin of the toner cores, the polyester resin preferably has a number average molecular weight (Mn) of at least 1,000 and no greater than 2,000 in order to improve toner core strength and toner fixability. The polyester resin preferably has a molecular weight distribution (ratio Mw/Mn of mass average molecular weight (Mw) to number average molecular weight (Mn)) of at least 9 and no greater than 21.

(Colorant)

The toner cores may contain a colorant. The colorant can be a commonly known pigment or dye that matches the color of the toner. In order to achieve high quality image formation using the toner, the amount of the colorant is preferably at least 1 part by mass and no greater than 20 parts by mass relative to 100 parts by mass of the binder resin.

The toner cores may contain a black colorant. Examples of black colorants include carbon black. Alternatively, a colorant that is adjusted to a black color using a yellow colorant, a magenta colorant, and a cyan colorant can be used as a black colorant.

The toner cores may include a non-black colorant such as a yellow colorant, a magenta colorant, or a cyan colorant.

The yellow colorant that can be used is for example one or more compounds selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example one or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example one or more compounds selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may contain a releasing agent. The releasing agent is for example used in order to improve fixability or offset resistance of the toner. In order to increase the anionic strength of the toner cores, the toner cores are preferably prepared using an anionic wax. In order to improve fixability or resistance to being offset of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block polymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One releasing agent may be used independently, or two or more releasing agents may be used in combination.

In order to improve compatibility between the binder resin and the releasing agent, a compatibilizer may be added to the toner cores.

(Charge Control Agent)

The toner cores may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased by including a negatively chargeable charge control agent (specific examples include organic metal complexes and chelate compounds) in the toner cores. The cationic strength of the toner cores can be increased by including a positively chargeable charge control agent (specific examples include pyridine, nigrosine, and quaternary ammonium salts) in the toner cores. However, when it is ensured that the toner has sufficient chargeability, the toner cores do not need to contain a charge control agent.

(Magnetic Powder)

The toner cores may contain a magnetic powder. Examples of materials of the magnetic powder that can be preferably used include ferromagnetic metals (specific examples include iron, cobalt, nickel, and alloys of any one or two of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

The magnetic powder is preferably subjected to surface treatment in order to inhibit elution of metal ions (for example, iron ions) from the magnetic powder. In a situation in which the shell layers are formed on the surfaces of the toner cores under acidic conditions, elution of metal ions to the surfaces of the toner cores causes the toner cores to adhere to one another more readily. It is thought that inhibiting elution of metal ions from the magnetic powder thereby inhibits the toner cores from adhering to one another.

[Shell Layer]

The toner according to the present embodiment has the above-described basic feature. The shell layers each contain the first resin particles and the second resin particles. The first resin particles may be substantially composed of a thermoplastic resin (specific examples include the "Preferable Thermoplastic Resins" listed above), and so may the second resin particles.

In order to obtain a toner that is excellent in chargeability, high-temperature preservability, and low-temperature fixability, it is particularly preferable that both the first resin particles and the second resin particles are substantially composed of a styrene-acrylic acid-based resin (specific examples include copolymers of styrene and an acrylic acid ester). The styrene-acrylic acid-based resin tends to have better charge stability (more specifically, tends to be less prone to charge decay) than the acrylic acid-based resin. Particularly preferably, the styrene-based monomer for synthesis of the styrene-acrylic acid-based resin is styrene or an alkyl styrene having an alkyl group having a carbon number of at least 1 and no greater than 6. Particularly preferably, the acrylic acid-based monomer for synthesis of the styrene-acrylic acid-based resin is an alkyl (meth)acrylate having an alkyl group having a carbon number of at least 1 and no greater than 6 in an ester moiety thereof.

The shell layers may each contain the third resin particles. The third resin particles contain a charge control agent. In order that the third resin particles contain a charge control agent, a repeating unit derived from the charge control agent may be incorporated in the resin forming the third resin particles, or charged particles may be dispersed in the resin forming the third resin particles. However, in order to obtain a toner that is excellent in chargeability, high-temperature preservability, and low-temperature fixability, it is preferable that the third resin particles are substantially composed of a resin having a repeating unit derived from a charge control agent, and it is particularly preferable that the third resin particles are substantially composed of a resin having a repeating unit derived from a (meth)acryloyl group-containing quaternary ammonium compound. Examples of (meth) acryloyl group-containing quaternary ammonium compounds that can be preferably used include (meth) acrylamidoalkyltrimethylammonium salts (specific examples include (3-acrylamidopropyl)trimethylammonium chloride) and (meth)acryloyloxyalkyltrimethylammonium salts (specific examples include 2-(methacryloyloxy)ethyltrimethylammonium chloride). Examples of preferable resins for forming the third resin particles include a polymer of at least one alkyl (meth)acrylate having an alkyl group having a carbon number of at least 1 and no greater than 6 in an ester moiety thereof and at least one (meth)acryloyl group-containing quaternary ammonium compound. A compound having a vinyl group ($CH_2$═CH—) or a substituted vinyl group in which hydrogen is replaced is typically incorporated in a polymer (resin) as a repeating unit by addition polymerization through carbon-to-carbon double bonds "C═C".

In order to obtain a toner that is excellent in high-temperature preservability, low-temperature fixability, and positive chargeability, the third resin particles preferably have a number average primary particle diameter of at least 30 nm and less than 70 nm. In order to ensure sufficient positive chargeability of the toner, the third resin particles preferably have a glass transition point higher than the first resin particles. It is thought that reduced compatibility between the first resin particles and the third resin particles allows the third resin particles to readily fulfill a charge control function.

[External Additive]

Inorganic particles may be caused to adhere to the surfaces of the toner mother particles as an external additive. The external additive is for example used in order to improve fluidity or handleability of the toner. In order to improve fluidity or handleability of the toner, the amount of the external additive is preferably at least 0.5 parts by mass and no greater than 10 parts by mass relative to 100 parts by mass of the toner mother particles. Furthermore, in order to improve fluidity or handleability of the toner, the external additive preferably has a particle diameter of at least 0.01 μm and no greater than 1.0 μm.

Examples of external additive particles (inorganic particles) that can be preferably used include silica particles and particles of metal oxides (specific examples include alumina, titanium oxide, magnesium oxide, zinc oxide, strontium titanate, and barium titanate). One external additive may be used independently, or two or more external additives may be used in combination.

[Toner Production Method]

The following describes an example of a method for producing the toner having the above-described basic feature.

(Toner Core Preparation)

In order to readily obtain preferable toner cores, the toner cores are preferably prepared by an aggregation method or a pulverization method, and more preferably prepared by a pulverization method.

The following describes an example of the pulverization method. First, a binder resin (for example, a polyester resin having a glass transition point of no greater than 50° C.) and an internal additive (for example, at least one of a colorant, a releasing agent, a charge control agent, and a magnetic powder) are mixed. Next, the resultant mixture is melt-kneaded. Next, the resultant melt-kneaded product is pulverized, and the resultant pulverized product is classified. As a result, toner cores having a desired particle diameter is obtained.

The following describes an example of the aggregation method. First, fine particles of a binder resin (for example, a polyester resin having a glass transition point of no greater than 50° C.), a releasing agent, and a colorant are caused to aggregate in an aqueous medium until the particles have a desired particle diameter. Through the above, aggregated particles containing the binder resin, the releasing agent, and the colorant are formed. Next, the resultant aggregated particles are heated to cause components of the aggregated particles to coalesce. As a result, a dispersion of toner cores is obtained. Next, non-essential substances (surfactant and the like) are removed from the dispersion of the toner cores to give the toner cores.

(Shell Layer Formation)

First, an aqueous medium (for example, ion exchanged water) is prepared. In order to inhibit dissolution or elution of the toner core materials (in particular, the binder resin and the releasing agent) during the formation of the shell layers, the formation of the first resin layer (the layer including the first resin particles and the third resin particles) is preferably carried out in an aqueous medium. The aqueous medium is a medium in which water is a main component (specific examples include pure water and a liquid mixture of water and a polar medium). The aqueous medium may function as a solvent. Solute may be dissolved in the aqueous medium. The aqueous medium may function as a dispersion medium. Dispersoid may be dispersed in the aqueous medium. Examples of polar media that can be used for the aqueous medium include alcohols (specific examples include methanol and ethanol).

Next, the aqueous medium is adjusted to a specific pH (for example, pH 4) for example using an aqueous p-toluenesulfonic acid solution. Next, the toner cores, a suspension of the first resin particles (for example, resin particles having a number average primary particle diameter of at least 30 nm and less than 70 nm and a glass transition point of at least 65° C. and less than 80° C.), and a suspension of the third resin particles (for example, resin particles that have a number average primary particle diameter of at least 30 nm and less than 70 nm and a glass transition point of at least 65° C. and less than 120° C., and that contain a charge control agent) are added to the pH adjusted aqueous medium (for example, an acidic aqueous medium).

Both the first resin particles and the third resin particles adhere to the surfaces of the toner cores in the liquid. In order that the first resin particles and the third resin particles adhere to the surfaces of the toner cores in a uniform manner, a high degree of dispersion of the toner cores is preferably achieved in the liquid containing the first resin particles and the third resin particles. In order to achieve a high degree of dispersion of the toner cores in the liquid, a surfactant may be added to the liquid, or the liquid may be stirred using a powerful stirrer (for example, "Hivis Disper Mix", product of PRIMIX Corporation). In a situation in which the toner cores are anionic, aggregation of the toner cores can be inhibited by using an anionic surfactant having the same polarity. Examples of surfactants that can be used include sulfate ester salts, sulfonic acid salts, phosphate acid ester salts, and soaps.

Next, the liquid containing the toner cores, the first resin particles, and the third resin particles is heated under stirring to a predetermined target temperature (for example, a temperature selected from the range of from 50° C. to 85° C.) at a predetermined heating rate (for example, a rate selected from the range of from 0.1° C./minute to 3° C./minute). The liquid may be further maintained at the target temperature under stirring for a predetermined period of time (for example, a period of time selected from the range of from 30 minutes to 4 hours) as necessary. The first resin particles and the third resin particles adhere to the surfaces of the toner cores while the liquid is maintained at a high temperature (or while the liquid is being heated). As a result of the liquid being maintained at a temperature that is substantially equal to or higher than the glass transition point of the toner cores and that is sufficiently lower than the glass transition point of the first resin particles and the glass transition point of the third resin particles, only the toner cores (more specifically, the polyester resin present in the surfaces of the toner cores), among the toner cores, the first resin particles, and the third resin particles, can be melted. Thereafter, the liquid is cooled to cause solidification of the melted polyester resin, thereby fixing both the first resin particles and the third resin particles to the surfaces of the toner cores. More specifically, both the first resin particles and the third resin particles are fusion bonded to the polyester resin on the surfaces of the toner cores. It is thought that both the first resin particles and the third resin particles are bonded to the surfaces of the toner cores by for example anchoring effect. The first resin particles and the third resin particles that are two-dimensionally arranged on the surfaces of the toner cores form grainy resin layers (the respective first resin layers). As a result of the first resin layers (the layers each including the first resin particles and the third resin particles) being formed on the surfaces of the respective toner cores in the liquid, a dispersion containing the toner cores covered with the first resin layers (hereinafter, referred to as first coated particles) is obtained.

Next, the dispersion of the first coated particles is cooled to for example room temperature (approximately 25° C.). Next, the dispersion of the first coated particles is filtered using for example a Buchner funnel. Through the above, the first coated particles are separated from the liquid (solid-liquid separation), and thus a wet cake of the first coated particles is obtained. Next, the resultant wet cake of the first coated particles is washed. Next, the washed first coated particles are dried.

Next, the resultant first coated particles and the second resin particles (resin particles having a number average primary particle diameter of at least 70 nm and no greater than 200 nm and a glass transition point of at least 80° C.) are mixed using a mixer (for example, an UM mixer, product of Nippon Coke & Engineering Co., Ltd.) to cause the second resin particles to adhere to the surfaces of the first coated particles. It is thought that the second resin particles adhere to the first coated particles by physical force. More specifically, it is thought that the second resin particles adhere to the surfaces of the first resin particles and the surfaces of the third resin particles mainly by Van der Waals forces. The use of a mixer equipped with a stirring impeller allows the second resin particles to adhere to the first coated particles by mechanical impact force. As a result of the second resin particles adhering to the surfaces of the first coated particles, the second resin layers (the layers including the second resin particles) are formed on the respective first resin layers. As a result of the layered structure including the first resin layers and the second resin layers being formed on the surface of each toner core, the toner mother particles are obtained.

Thereafter, as necessary, the toner mother particles and an external additive may be mixed using a mixer (for example, an FM mixer or an UM mixer, product of Nippon Coke & Engineering Co., Ltd.) to cause the external additive to adhere to the surfaces of the toner mother particles. Thus, a toner including a plurality of toner particles is produced.

Procedures and the order of the processes in the above-described toner production method may be changed as appropriate in accordance with desired structure or properties of the toner. For causing a reaction of a material (for example, the shell material) in a liquid, for example, the material may be caused to react in the liquid for a specific period of time after the material is added to the liquid, or the material may be caused to react in the liquid while the material is being added to the liquid over a long period of time. The shell material may be added to the liquid as a single addition or may be divided up and added to the liquid as a plurality of additions. The toner may be sifted after the external additive addition process. Furthermore, non-essential processes may be omitted. In a situation in which a commercially available product can be used as is as a material, for example, a process of preparing the material can be omitted by using the commercially available product. In a situation in which the reaction for formation of the shell layers proceeds favorably without pH of the liquid being adjusted, the process of adjusting the pH may be omitted. In a situation in which an external additive is not necessary, the external additive addition process may be omitted. In a situation in which an external additive is not caused to adhere to the surfaces of the toner mother particles (the external additive addition process is omitted), the toner mother particles are equivalent to the toner particles. In a situation in which a resin is synthesized, a monomer or a prepolymer may be used as a material for synthesizing a resin. In order to obtain a specific compound, a salt, an ester, a hydrate, or an anhydride of the compound may be used as a material thereof. Preferably, a large number of the toner particles are formed at the same time in order that the toner can be produced efficiently.

EXAMPLES

Examples of the present invention will be described. Table 1 and Table 2 show toners TA-1 to TA-7, TB-1 to TB-5, TC-1 to TC-4, TD-1 to TD-5, TE-1 to TE-3, TF-1 to TF-5, TG-1 to TG-4, and TH-1 to TH-3 (each of which is an electrostatic latent image developing toner) according to Examples or Comparative Examples. "Particle diameter (unit: nm)" in Table 1 refers to a number average value of equivalent circle diameters of primary particles measured using a transmission electron microscope (TEM).

TABLE 1

| | First shell material | | | | Second shell material | | | |
|---|---|---|---|---|---|---|---|---|
| Toner | Type | Particle diameter [nm] | Tg [° C.] | Resin amount [g] | Type | Particle diameter [nm] | Tg [° C.] | Resin amount [g] |
| TA-1 | A1 | 31 | 71 | 3.0 | B1 | 78 | 83 | 4.5 |
| TA-2 | | | | 4.5 | | | | 4.5 |
| TA-3 | | | | 4.5 | | | | 2.3 |
| TA-4 | | | | 4.5 | | | | 1.5 |
| TA-5 | | | | 4.5 | | | | 7.5 |
| TA-6 | | | | 4.5 | | | | 10.5 |
| TA-7 | | | | 5.0 | | | | 4.5 |
| TB-1 | A1 | 31 | 71 | 4.5 | B2 | 176 | 86 | 1.5 |
| TB-2 | | | | | | | | 2.3 |
| TB-3 | | | | | | | | 4.5 |
| TB-4 | | | | | | | | 7.5 |
| TB-5 | | | | | | | | 10.5 |
| TC-1 | A1 | 31 | 71 | 4.5 | B3 | 224 | 84 | 2.3 |
| TC-2 | | | | | B3 | 224 | 84 | 7.5 |
| TC-3 | | | | | B4 | 172 | 132 | 7.5 |
| TC-4 | | | | | B5 | 180 | 75 | 7.5 |

TABLE 1-continued

| | First shell material | | | | Second shell material | | | |
|---|---|---|---|---|---|---|---|---|
| Toner | Type | Particle diameter [nm] | Tg [° C.] | Resin amount [g] | Type | Particle diameter [nm] | Tg [° C.] | Resin amount [g] |
| TD-1 | A2 | 67 | 77 | 3.1 | B1 | 78 | 83 | 4.5 |
| TD-2 | | | | 2.3 | | | | 4.5 |
| TD-3 | | | | 2.3 | | | | 2.3 |
| TD-4 | | | | 2.3 | | | | 1.5 |
| TD-5 | | | | 2.3 | | | | 0.8 |
| TE-1 | A2 | 67 | 77 | 2.3 | B2 | 176 | 86 | 1.5 |
| TE-2 | | | | | | | | 2.3 |
| TE-3 | | | | | | | | 4.5 |
| TF-1 | A2 | 67 | 77 | 2.3 | B3 | 224 | 84 | 1.5 |
| TF-2 | | | | | B3 | 224 | 84 | 3.0 |
| TF-3 | | | | | B4 | 172 | 132 | 3.0 |
| TF-4 | | | | | B5 | 180 | 75 | 3.0 |
| TF-5 | | | | | B6 | 65 | 84 | 3.0 |
| TG-1 | A2 | 67 | 77 | 1.6 | B1 | 78 | 83 | 2.3 |
| TG-2 | | | | 4.7 | | | | 4.5 |
| TG-3 | | | | 6.2 | | | | 4.5 |
| TG-4 | | | | 7.3 | | | | 4.5 |
| TH-1 | A3 | 67 | 84 | 6.0 | B1 | 78 | 83 | 4.5 |
| TH-2 | A4 | 80 | 76 | 7.4 | | | | |
| TH-3 | A5 | 97 | 77 | 4.5 | | | | |

TABLE 2

| Toner | First shell coverage [%] | Second/First shell ratio (B/A) |
|---|---|---|
| TA-1 | 68 | 1.5 (=4.5/3.0) |
| TA-2 | 79 | 1.0 (=4.5/4.5) |
| TA-3 | 79 | 0.5 (=2.3/4.5) |
| TA-4 | 79 | 0.3 (=1.5/4.5) |
| TA-5 | 79 | 1.7 (=7.5/4.5) |
| TA-6 | 79 | 2.3 (=10.5/4.5) |
| TA-7 | 86 | 0.9 (=4.5/5.0) |
| TB-1 | 79 | 0.3 (=1.5/4.5) |
| TB-2 | 79 | 0.5 (=2.3/4.5) |
| TB-3 | 79 | 1.0 (=4.5/4.5) |
| TB-4 | 79 | 1.7 (=7.5/4.5) |
| TB-5 | 79 | 2.3 (=10.5/4.5) |
| TC-1 | 79 | 0.5 (=2.3/4.5) |
| TC-2 | 79 | 1.7 (=7.5/4.5) |
| TC-3 | 79 | 1.7 (=7.5/4.5) |
| TC-4 | 79 | 1.7 (=7.5/4.5) |
| TD-1 | 55 | 1.5 (=4.5/3.1) |
| TD-2 | 42 | 2.0 (=4.5/2.3) |
| TD-3 | 42 | 1.0 (=2.3/2.3) |
| TD-4 | 42 | 0.7 (=1.5/2.3) |
| TD-5 | 42 | 0.3 (=0.8/2.3) |
| TE-1 | 42 | 0.7 (=1.5/2.3) |
| TE-2 | 42 | 1.0 (=2.3/2.3) |
| TE-3 | 42 | 2.0 (=4.5/2.3) |
| TF-1 | 42 | 0.7 (=1.5/2.3) |
| TF-2 | 42 | 1.3 (=3.0/2.3) |
| TF-3 | 42 | 1.3 (=3.0/2.3) |
| TF-4 | 42 | 1.3 (=3.0/2.3) |
| TF-5 | 42 | 1.3 (=3.0/2.3) |
| TG-1 | 32 | 1.5 (=2.3/1.6) |
| TG-2 | 68 | 1.0 (=4.5/4.7) |
| TG-3 | 76 | 0.8 (=4.5/6.2) |
| TG-4 | 83 | 0.6 (=4.5/7.3) |
| TH-1 | 74 | 0.8 (=4.5/6.0) |
| TH-2 | 74 | 0.6 (=4.5/7.4) |
| TH-3 | 43 | 1.0 (=4.5/4.5) |

The following describes, in order, production methods, evaluation methods, and evaluation results of the toners TA-1 to TH-3. In evaluations in which errors might occur, an evaluation value was determined by obtaining an appropriate number of measurement values in order to ensure that any errors were sufficiently small and calculating an arithmetic mean of the measurement values. Tg (glass transition point) and Tm (softening point) were measured according to the methods described below, unless otherwise stated.

<Tg Measurement Method>

A heat absorption curve (vertical axis: heat flow (DSC signal), horizontal axis: temperature) for a sample (for example, a resin) was plotted using a differential scanning calorimeter ("DSC-6220", product of Seiko Instruments Inc.). Next, Tg (glass transition point) of the sample was read from the obtained heat absorption curve. Tg (glass transition point) of the sample corresponds to a point of change in specific heat on the obtained heat absorption curve (an intersection point of an extrapolation of the base line and an extrapolation of the inclined portion of the curve).

<Tm Measurement Method>

A sample (for example, a resin) was placed in a capillary rheometer ("CFT-500D", product of Shimadzu Corporation) and an S-shaped curve (horizontal axis: temperature, vertical axis: stroke) of the sample was plotted by causing melt-flow of 1 $cm^3$ of the sample under conditions of a die diameter of 1 mm, a plunger load of 20 $kg/cm^2$, and a heating rate of 6° C./minute. Next, Tm of the sample was read from the obtained S-shaped curve. Tm (softening point) of the sample is a temperature on the S-shaped curve corresponding to a stroke value of $(S_1+S_2)/2$, where $S_1$ represents a maximum stroke value and $S_2$ represents a base line stroke value at low temperatures.

[Production Method of Toners TA-1 to TH-3]

(Preparation of Toner Cores)

A polyester resin (a binder resin for toner cores) was synthesized by causing a reaction between bisphenol A ethylene oxide adduct (more specifically, an alcohol produced through addition of ethylene oxide to a bisphenol A framework) and an acid having multiple functional groups (more specifically, terephthalic acid). The resultant polyester resin had a hydroxyl value of 20 mgKOH/g, an acid value of 40 mgKOH/g, a Tm of 90° C., a Tg of 49° C., and an SP value of 11.2.

The thus obtained polyester resin in an amount of 100 parts by mass, a releasing agent ("Nissan Electol (registered Japanese trademark) WEP-3", product of NOF Corporation, an ester wax having a melting point of 73° C.) in an amount of 5 parts by mass, and a colorant (C.I. Pigment Blue 15:3, ingredient: copper phthalocyanine pigment) in an amount of 5 parts by mass were mixed using an FM mixer ("FM-20B", product of Nippon Coke & Engineering Co., Ltd.) at a rotational speed of 2,400 rpm.

Next, the resultant mixture was melt-kneaded using a twin-screw extruder ("PCM-30", product of Ikegai Corp.). Next, the resultant kneaded product was cooled. Next, the cooled kneaded product was pulverized using Turbo Mill (product of FREUND-TURBO CORPORATION). Next, the resultant pulverized product was classified using a classifier ("Elbow Jet EJ-LABO", product of Nittetsu Mining Co., Ltd.). As a result, toner cores (more specifically, ground cores) having a volume median diameter ($D_{50}$) of 6 μm were obtained. The resultant toner cores had a roundness of 0.93, a Tm of 91° C., and a Tg of 51° C.

(Preparation of Suspension A1)

A 1-L three-necked flask having a thermometer and a stirring impeller was set up in a water bath, and 815.0 mL of ion exchanged water at approximately 30° C. and 75 mL of a cationic surfactant ("QUARTAMIN (registered Japanese trademark) 24P", product of Kao Corporation, a 25% by mass aqueous lauryltrimethylammonium chloride solution) were added into the flask. Next, the internal temperature of the flask was heated up to 80° C. using the water bath. Next, two different liquids (a first liquid and a second liquid) were each dripped into the flask contents at 80° C. over 5 hours. The first liquid was a liquid mixture of 68.0 mL of styrene and 12.0 mL of butyl acrylate. The second liquid was a solution of 0.5 g of potassium peroxodisulfate dissolved in 30 mL of ion exchanged water. Next, the internal temperature of the flask was maintained at 80° C. for further 2 hours to cause polymerization of the flask contents. As a result, a suspension A1 containing the first resin particles (solid concentration: 8.0% by mass) was obtained. The fine resin particles (the first resin particles) contained in the resultant suspension A1 had a number average primary particle diameter of 31 nm and a Tg of 71° C.

(Preparation of Suspension A2)

A suspension A2 was prepared according to the same method as the preparation method of the suspension A1 in all aspects other than that, regarding the added amount of each material, the amount of the ion exchanged water was changed from 815.0 mL to 870.6 mL, the amount of the cationic surfactant (QUARTAMIN 24P) was changed from 75 mL to 20 mL, the amount of the styrene was changed from 68.0 mL to 70.2 mL, and the amount of the butyl acrylate was changed from 12.0 mL to 9.2 mL. The fine resin particles (the first resin particles) contained in the resultant suspension A2 had a solid concentration of 7.7% by mass, a number average primary particle diameter of 67 nm, and a Tg of 77° C.

(Preparation of Suspension A3)

A suspension A3 was prepared according to the same method as the preparation method of the suspension A1 in all aspects other than that, regarding the added amount of each material, the amount of the ion exchanged water was changed from 815.0 mL to 871.2 mL, the amount of the cationic surfactant (QUARTAMIN 24P) was changed from 75 mL to 20 mL, the amount of the styrene was changed from 68.0 mL to 72.8 mL, and the amount of the butyl acrylate was changed from 12.0 mL to 6.0 mL. The fine resin particles (the first resin particles) contained in the resultant suspension A3 had a solid concentration of 8.0% by mass, a number average primary particle diameter of 67 nm, and a Tg of 84° C.

(Preparation of Suspension A4)

A suspension A4 was prepared according to the same method as the preparation method of the suspension A1 in all aspects other than that, regarding the added amount of each material, the amount of the ion exchanged water was changed from 815.0 mL to 875.6 mL, the amount of the cationic surfactant (QUARTAMIN 24P) was changed from 75 mL to 15 mL, the amount of the styrene was changed from 68.0 mL to 70.2 mL, and the amount of the butyl acrylate was changed from 12.0 mL to 9.2 mL. The fine resin particles (the first resin particles) contained in the resultant suspension A4 had a solid concentration of 8.1% by mass, a number average primary particle diameter of 80 nm, and a Tg of 76° C.

(Preparation of Suspension A5)

A suspension A5 was prepared according to the same method as the preparation method of the suspension A1 in all aspects other than that, regarding the added amount of each material, the amount of the ion exchanged water was changed from 815.0 mL to 880.6 mL, the amount of the cationic surfactant (QUARTAMIN 24P) was changed from 75 mL to 10 mL, the amount of the styrene was changed from 68.0 mL to 70.2 mL, and the amount of the butyl acrylate was changed from 12.0 mL to 9.2 mL. The fine resin particles (the first resin particles) contained in the resultant suspension A5 had a solid concentration of 8.1% by mass, a number average primary particle diameter of 97 nm, and a Tg of 77° C.

(Preparation of Second Resin Particles B1)

A 1-L three-necked flask having a thermometer, a cooling tube, a nitrogen inlet tube, and a stirring impeller was set up in a water bath, and 876.2 mL of ion exchanged water at approximately 30° C. and 15.0 mL of a cationic surfactant ("QUARTAMIN 24P", product of Kao Corporation, a 25% by mass aqueous lauryltrimethylammonium chloride solution) were added into the flask. Next, the internal temperature of the flask was raised up to 80° C. using the water bath. Next, two different liquids (a first liquid and a second liquid) were each dripped into the flask contents at 80° C. over 5 hours.

The first liquid was a liquid mixture of 72.8 mL of styrene and 6.0 mL of butyl acrylate. The second liquid was a solution of 0.5 g of potassium peroxodisulfate dissolved in 30 mL of ion exchanged water. Next, the internal temperature of the flask was maintained at 80° C. for further 2 hours to cause polymerization of the flask contents. As a result, a suspension containing the second resin particles was obtained. Next, the second resin particles in the suspension were caused to sediment by centrifugation and the resultant supernatant was removed. Next, the second resin particles left in the flask were dried to give dried second resin particles B 1. The second resin particles B1 had a number average primary particle diameter of 78 nm and a Tg of 83° C.

(Preparation of Second Resin Particles B2)

Second resin particles B2 were prepared according to the same method as the preparation method of the second resin particles B1 in all aspects other than that, regarding the added amount of each material, the amount of the ion exchanged water was changed from 876.2 mL to 882.5 mL, the amount of the cationic surfactant (QUARTAMIN 24P) was changed from 15.0 mL to 4.5 mL, the amount of the styrene was changed from 72.8 mL to 73.8 mL, and the amount of the butyl acrylate was changed from 6.0 mL to 9.2 mL. The second resin particles B2 had a number average primary particle diameter of 176 nm and a Tg of 86° C.

(Preparation of Second Resin Particles B3)

Second resin particles B3 were prepared according to the same method as the preparation method of the second resin particles B1 in all aspects other than that, regarding the added amount of each material, the amount of the ion exchanged water was changed from 876.2 mL to 871.2 mL, and the amount of the cationic surfactant (QUARTAMIN 24P) was changed from 15.0 mL to 20.0 mL. The second resin particles B3 had a number average primary particle diameter of 224 nm and a Tg of 84° C.

(Preparation of Second Resin Particles B4)

Second resin particles B4 were prepared according to the same method as the preparation method of the second resin particles B1 in all aspects other than that the amount of the ion exchanged water was changed from 876.2 mL to 874.0 mL, the amount of the cationic surfactant (QUARTAMIN 24P) was changed from 15.0 mL to 3.0 mL, and a liquid mixture of 48.6 mL of 4-tert-butylstyrene and 44.4 mL of methyl methacrylate was used as the first liquid instead of the liquid mixture of 72.8 mL of styrene and 6.0 mL of butyl acrylate. The second resin particles B4 had a number average primary particle diameter of 172 nm and a Tg of 132° C.

(Preparation of Second Resin Particles B5)

Second resin particles B5 were prepared according to the same method as the preparation method of the second resin particles B1 in all aspects other than that, regarding the added amount of each material, the amount of the ion exchanged water was changed from 876.2 mL to 886.1 mL, the amount of the cationic surfactant (QUARTAMIN 24P) was changed from 15.0 mL to 4.5 mL, the amount of the styrene was changed from 72.8 mL to 70.2 mL, and the amount of the butyl acrylate was changed from 6.0 mL to 9.2 mL. The second resin particles B5 had a number average primary particle diameter of 180 nm and a Tg of 75° C.

(Preparation of Second Resin Particles B6)

Second resin particles B6 were prepared according to the same method as the preparation method of the second resin particles B1 in all aspects other than that, regarding the added amount of each material, the amount of the ion exchanged water was changed from 876.2 mL to 871.2 mL, and the amount of the cationic surfactant (QUARTAMIN 24P) was changed from 15.0 mL to 3.0 mL. The second resin particles B6 had a number average primary particle diameter of 65 nm and a Tg of 84° C.

(Preparation of Suspension C)

A 1-L three-necked flask having a thermometer and a stirring impeller was set up in a water bath, and 790.0 mL of ion exchanged water at approximately 30° C. and 30 mL of a cationic surfactant ("QUARTAMIN 24P", product of Kao Corporation, a 25% by mass aqueous lauryltrimethylammonium chloride solution) were added into the flask. Next, the internal temperature of the flask was raised up to 80° C. using the water bath. Next, two different liquids (a first liquid and a second liquid) were each dripped into the flask contents at 80° C. over 5 hours. The first liquid was a liquid mixture of 100 mL of methyl methacrylate, 30 mL of butyl acrylate, and 20 mL of (3-acrylamidopropyl)trimethylammonium chloride (75% by mass aqueous solution). The second liquid was a solution of 0.5 g of potassium peroxodisulfate dissolved in 30 mL of ion exchanged water. Next, the internal temperature of the flask was maintained at 80° C. for further 2 hours to cause polymerization of the flask contents. As a result, a suspension C containing the third resin particles (solid concentration: 15.0% by mass) was obtained. The fine resin particles (the third resin particles) contained in the resultant suspension C had a number average primary particle diameter of 55 nm and a Tg of 103° C.

(Shell Layer Formation)

A three-necked flask having a thermometer and a stirring impeller was prepared, and the flask was set up in a water bath. Next, 300 mL of ion exchanged water was added into the flask, and the internal temperature of the flask was maintained at 30° C. using the water bath. Next, the flask content was adjusted to pH 4 through addition of an aqueous p-toluenesulfonic acid solution of a concentration of 1 mol/L to the flask.

Next, the first shell material (one of the suspensions A1 to A5 specified for the respective toners TA-1 to TH-3 as shown in Table 1) and 1.92 g of the suspension C (the suspension containing the third resin particles) prepared as described above were added into the flask. The amount of the first shell material was determined so as to give a corresponding one of the values of the resin amount shown in Table 1. For example, 37.5 g (=3.0/0.08) of the suspension A1 (solid concentration: 8.0% by mass) was added into the flask so that the resin was added in an amount of 3.0 g in the production of the toner TA-1. Next, 300 g of the toner cores (the powder) prepared as described above were added into the flask, and the flask contents were stirred sufficiently. As a result, a dispersion of the toner cores was obtained in the flask.

Into the flask, 300 mL of ion exchanged water was added, and the flask contents were heated up to 50° C. at a rate of 1.0° C./minute under stirring at a rotational speed of 100 rpm. Once the internal temperature of the flask reached 50° C., a liquid mixture having a temperature of 50° C. and including 20 g of an aqueous disodium hydrogen phosphate solution having a concentration of 0.5 mol/L and 10 g of an aqueous solution of an anionic surfactant ("Emal (registered Japanese trademark) 0", product of Kao Corporation, ingredient: sodium lauryl sulfate) having a concentration of 10% by mass was added into the flask. Furthermore, the heating of the flask contents was continued at a rate of 1.0° C./minute under stirring of the flask contents at a rotational speed of 100 rpm. Once the toner reached a roundness of 0.965, the heating of the flask contents was stopped. Next, the flask contents were cooled until the temperature thereof was room temperature (approximately 25° C.). As a result, a dispersion containing the toner cores (the first coated particles) each covered with the first resin layer (the layer including the first resin particles and the third resin particles) was obtained.

(Washing) The dispersion of the first coated particles obtained as described above was filtered (solid-liquid separation) to yield the first coated particles. Next, the thus obtained first coated particles were re-dispersed in ion exchanged water. Dispersion and filtration were repeated for washing the first coated particles.

(Drying)

Next, the resultant first coated particles were dispersed in a 50% by mass aqueous ethanol solution. Through the above, a slurry of the first coated particles was obtained. Next, a continuous type surface modifier ("Coatmizer (registered Japanese trademark)", product of Freund Corporation) was used to dry the first coated particles in the slurry at a hot air temperature of 45° C. and a blower flow rate of 2 $m^3$/minute. As a result, the dried first coated particles (a powder) were obtained.

Next, 200 g of the resultant first coated particles and the second shell material (one of the second resin particles B1 to B6 specified for the respective toners TA-1 to TH-3 as shown in Table 1) were mixed for 10 minutes using an UM mixer (product of Nippon Coke & Engineering Co., Ltd.) to cause the second resin particles to adhere to the surfaces of the first coated particles. As a result, toner mother particles were obtained. The addition amount of the second shell material was determined so as to give a corresponding one of the values of the ratio of mass of the second shell material to mass of the first shell material in terms of resin amount (the second/first shell ratio) shown in Table 2. For example, 3.0 g of the first shell material in terms of resin amount was added in the production of the toner TA-1. Accordingly, 4.5 g (=1.5×3.0 g) of the second resin particles B1 were added so as to give a second/first shell ratio of 1.5.

(External Additive Addition)

After the drying, an external additive was added to the toner mother particles. More specifically, 100 parts by mass of the toner mother particles and 1.5 parts by mass of positively chargeable silica particles ("AEROSIL (registered Japanese trademark) REA90", product of Nippon Aerosil Co., Ltd.) were mixed for 5 minutes using an UM mixer (product of Nippon Coke & Engineering Co., Ltd.) to cause the external additive (the silica particles) to adhere to the surfaces of the toner mother particles. Next, the resultant toner was sifted using a 200 mesh screen (opening 75 μm). As a result, a toner (among the toners TA-1 to TH-3) including a plurality of toner particles was obtained.

The coverage by the first resin particles (the first shell coverage) of each of the toners TA-1 to TH-3 obtained as described above was measured, and results thereof were as shown in Table 2. The number average primary particle diameter of the first resin particles, the number average primary particle diameter of the second resin particles, and the number average primary particle diameter of the third resin particles were each equal to the particle diameter at the time of addition thereof (see Table 1). For example, with respect to the toner TA-1, the first resin particles had a number average primary particle diameter of 31 nm, the second resin particles had a number average primary particle diameter of 78 nm, the third resin particles had a number average primary particle diameter of 55 nm, and the first shell coverage was 68%. The first shell coverage was measured as described below.

<Measurement Method of First Shell Coverage>

The sample (toner) was dyed in ruthenium. A toner particle in the dyed sample was observed using a field effect scanning electron microscope (FE-SEM) ("JSM-7600F", product of JEOL Ltd.) and a backscattered electron image of the toner particle was captured. The speed of dyeing in ruthenium varies according to resins. For example, a polyester resin and a styrene-acrylic acid-based resin are greatly different in the speed of dyeing in ruthenium. Accordingly, there was contrast (luminance difference) between the toner core and the first resin particles on the backscattered electron image captured (more specifically, the backscattered electron image of the surface of the toner particle), allowing the toner core and the first resin particles to be distinguished from each other. Binarization was performed based on luminance values of pixels using image-analyzing software ("WinROOF", product of Mitani Corporation) to obtain a binary image. Next, in the binary image, an area of a region, of the surface of the toner core, that was covered with the first resin particles (hereinafter, referred to as an area A1) and an area of the entire surface of the toner core (hereinafter, referred to as an area A2) were measured. Then, the first shell coverage was calculated in accordance with a formula "First shell coverage=100×Area A1/Area A2".

[Evaluation Methods]

Each of the samples (the toners TA-1 to TH-3) was evaluated according to the methods described below.

(High-Temperature Preservability)

A polyethylene container having a capacity of 20 mL was charged with 3 g of the sample (toner), and then sealed. Tapping was performed on the sealed container for 5 minutes. Next, the container was left to stand for 3 hours in a thermostatic chamber set to a specific temperature (55° C. or 58° C.). Next, the container in the thermostatic chamber was cooled to 20° C., and then the container was taken out of the thermostatic chamber. As a result, an evaluation toner was obtained.

Next, the evaluation toner was placed on a sieve having a known mass and a pore diameter of 106 μm. The mass of the evaluation toner prior to sifting was calculated by measuring the total mass of the sieve and the toner thereon. Next, the sieve was placed in a powder tester (product of Hosokawa Micron Corporation) and the sieve was shaken in accordance with a manual of the powder tester for 30 seconds at an oscillation strength corresponding to a rheostat level of 5. After the sifting, the mass of the toner remaining on the sieve was calculated by measuring the total mass of the sieve and the toner thereon. Aggregation rate (unit: % by mass) was calculated based on the mass of the toner prior to sifting and the mass of the toner after sifting (the mass of the toner remaining on the sieve) in accordance with a formula shown below.

Aggregation rate=100×Mass of toner after sifting/Mass of toner prior to sifting

The aggregation rate was calculated for both the case where the temperature of the thermostatic chamber was set to 55° C. and the case where the temperature of the thermostatic chamber was set to 58° C. The evaluation standard based on the aggregation rate was as follows.

VG (Very Good): The aggregation rate was no greater than 20% by mass in both the test at a temperature of 55° C. and the test at 58° C.

G (Good): The aggregation rate was greater than 20% by mass in the test at 58° C., and the aggregation rate was no greater than 20% by mass in the test at 55° C.

P (Poor): The aggregation rate was greater than 20% by mass in both the test at 55° C. and the test at 58° C.

(Image Density Retention)

A ball mill was used to mix 100 parts by mass of a ferrite carrier (a carrier for "FS-C5100DN", product of KYOCERA Document Solutions Inc.) and 11 parts by mass of the sample (toner) for 30 minutes to give an evaluation developer.

A color printer ("FS-C5100DN", product of KYOCERA Document Solutions Inc.) was used as an evaluation apparatus. The evaluation developer prepared as described above was loaded into a developing device of the evaluation apparatus, and the sample (toner for replenishment use) was loaded into a toner container of the evaluation apparatus.

The evaluation apparatus was used to perform a printing durability test by printing 1,000 successive sheets of paper (A4 size plain paper) with a coverage of 1% under environmental conditions of 23° C. and 60% RH. A sample image including a solid portion and a blank portion was formed on a recording medium (an evaluation sheet) using the evaluation apparatus at timings before and after the printing durability test (initial and post-printing durability test). The image density (ID) of the solid portion of the image formed on the recording medium was measured using a reflectance densitometer ("RD914", product of X-Rite Inc.). Based on the measured image density (ID), an amount of change in the image density (ID change) was calculated in accordance with the following formula.

ID change=Initial ID−Post-printing durability test ID

Only samples (toners) whose result of the high-temperature preservability evaluation was not P (poor) were evaluated for image density retention. The evaluation standard based on the measured ID change was as follows.

VG (Very Good): The ID change was less than 0.1.

G (Good): The ID change was at least 0.1 and less than 0.2.

P (Poor): The ID change was at least 0.2.

(Low-Temperature Fixability)

A printer (an evaluation apparatus obtained by modifying "FS-05250DN", product of KYOCERA Document Solutions Inc., to enable adjustment of fixing temperature) having a roller-roller type heat-pressure fixing device (width of a nip: 8 mm) was used as an evaluation apparatus. A ball mill was used to mix 100 parts by mass of a ferrite carrier (a carrier for "FS-05100DN", product of KYOCERA Document Solutions Inc.) and 11 parts by mass of the sample (toner) for 30 minutes to give an evaluation developer. The evaluation developer prepared as described above was loaded into a developing device of the evaluation apparatus, and the sample (toner for replenishment use) was loaded into a toner container of the evaluation apparatus.

The evaluation apparatus was used to convey paper having a basis weight of 90 g/m$^2$ (A4 size plain paper) at a linear velocity of 200 mm/second under environmental conditions of 23° C. and 60% RH, and a solid image was formed at a toner application amount of 1.0 mg/cm$^2$ on the paper being conveyed. Next, the paper on which the image was formed was passed through the fixing device of the evaluation apparatus. The transit time of the paper through the nip was 40 milliseconds. The fixing temperature was set in a range of from 120° C. to 160° C. More specifically, the fixing temperature of the fixing device was gradually increased from 120° C. in increments of 2° C. to measure the minimum temperature at which the toner (the solid image) was fixable to the paper (minimum fixing temperature). Determination of whether or not the toner was fixable was carried out through a fold-rubbing test (measurement of length of toner peeling of a fold) such as described below. The fold-rubbing test was performed by folding the paper such that a surface on which the image was formed was folded inwards, and by rubbing a 1 kg weight covered with cloth back and forth on the fold five times. Next, the paper was opened up and a fold portion (a portion on which the solid image was formed) of the paper was observed. Subsequently, the length of toner peeling of the fold portion (peeling length) was measured. The minimum fixing temperature was determined to be the lowest temperature among fixing temperatures for which the peeling length was less than 1 mm.

Only samples (toners) whose results of the high-temperature preservability evaluation and the image density retention evaluation were not P (poor) were evaluated for low-temperature fixability. The evaluation standard based on the minimum fixing temperature was determined to be as follows based on a minimum fixing temperature (124° C.) of non-capsule toner particles (toner particles having no shell layers).

VG (Very Good): The minimum fixing temperature was no greater than 134° C.

G (Good): The minimum fixing temperature was greater than 134° C. and no greater than 144° C.

P (Poor): The minimum fixing temperature was greater than 144° C.

[Evaluation Results]

Table 3 shows evaluation results (high-temperature preservability: aggregation rate, image density retention: ID change, low-temperature fixability: minimum fixing temperature) of the toners TA-1 to TH-3. The high-temperature preservability, the image density retention, and the low-temperature fixability of each toner were evaluated in the stated order. Once the toner had a poor evaluation result, the evaluation thereof was ended. The symbol "-" in Table 3 indicates that the evaluation of the property was not performed.

TABLE 3

| | | High-temperature preservability [mass %] | | Image density | Minimum fixing temperature |
|---|---|---|---|---|---|
| | Toner | 55° C. | 58° C. | retention | [° C.] |
| Example 1 | TA-1 | 5 | 12 | VG | 134 |
| Example 2 | TA-2 | 4 | 10 | VG | 138 |
| Example 3 | TA-3 | 4 | 9 | G | 134 |
| Example 4 | TA-5 | 4 | 8 | VG | 142 |
| Example 5 | TB-2 | 15 | 40 | G | 134 |
| Example 6 | TB-3 | 10 | 35 | VG | 138 |
| Example 7 | TB-4 | 4 | 9 | VG | 142 |
| Example 8 | TC-3 | 3 | 7 | VG | 144 |
| Example 9 | TD-1 | 10 | 40 | VG | 142 |

TABLE 3-continued

| | Toner | High-temperature preservability [mass %] 55° C. | 58° C. | Image density retention | Minimum fixing temperature [° C.] |
|---|---|---|---|---|---|
| Example 10 | TD-2 | 13 | 40 | VG | 144 |
| Example 11 | TD-3 | 16 | 50 | VG | 134 |
| Example 12 | TD-4 | 18 | 60 | G | 132 |
| Example 13 | TE-1 | 16 | 55 | G | 132 |
| Example 14 | TE-2 | 13 | 40 | VG | 134 |
| Example 15 | TE-3 | 9 | 30 | VG | 138 |
| Example 16 | TF-3 | 10 | 30 | VG | 144 |
| Example 17 | TG-2 | 7 | 20 | VG | 140 |
| Example 18 | TG-3 | 5 | 14 | G | 144 |
| Comparative Example 1 | TA-4 | 14 | 40 | P | — |
| Comparative Example 2 | TA-6 | 4 | 7 | VG | 150 (P) |
| Comparative Example 3 | TA-7 | 3 | 6 | VG | 148 (P) |
| Comparative Example 4 | TB-1 | 17 | 50 | P | — |
| Comparative Example 5 | TB-5 | 4 | 7 | VG | 148 (P) |
| Comparative Example 6 | TC-1 | 14 | 40 | P | — |
| Comparative Example 7 | TC-2 | 4 | 8 | P | — |
| Comparative Example 8 | TC-4 | 4 | 9 | P | — |
| Comparative Example 9 | TD-5 | 31 (P) | 80 | — | — |
| Comparative Example 10 | TF-1 | 13 | 45 | P | — |
| Comparative Example 11 | TF-2 | 11 | 35 | P | — |
| Comparative Example 12 | TF-4 | 10 | 30 | P | — |
| Comparative Example 13 | TF-5 | 13 | 40 | P | — |
| Comparative Example 14 | TG-1 | 41 (P) | 90 | — | — |
| Comparative Example 15 | TG-4 | 3 | 7 | G | 150 (P) |
| Comparative Example 16 | TH-1 | 5 | 12 | G | 150 (P) |
| Comparative Example 17 | TH-2 | 5 | 13 | G | 152 (P) |
| Comparative Example 18 | TH-3 | 16 | 45 | VG | 146 (P) |

The toners TA-1 to TA-3, TA-5, TB-2 to TB-4, TC-3, TD-1 to TD-4, TE-1 to TE-3, TF-3, TG-2, and TG-3 (the toners according to Examples 1 to 18) each had the above-described basic feature. More specifically, the toner cores of each of the toners according to Examples 1 to 18 contained a polyester resin. As shown in Table 1, the shell layers thereof included: the plurality of first resin particles (more specifically, resin particles substantially composed of a styrene-acrylic acid-based resin) having a number average primary particle diameter of at least 30 nm and less than 70 nm and a glass transition point of less than 80° C.; and the plurality of second resin particles (more specifically, resin particles substantially composed of a styrene-acrylic acid-based resin) having a number average primary particle diameter of at least 70 nm and no greater than 200 nm and a glass transition point of at least 80° C. As shown in Table 2, the first shell coverage thereof (the percentage of an area of each toner core that is covered with the first resin particles relative to a surface area of the toner core) was at least 40% and no greater than 80%. As shown in Table 2, the second/first shell ratio thereof (the ratio of the total mass of the second resin particles to the total mass of the first resin particles) was at least 0.5 and no greater than 2.0.

In the production of each of the toners according to Examples 1 to 18, the above-described layered structure (lower layer: the first resin layer including the first resin particles and the third resin particles, upper layer: the second resin layer including the second resin particles) was formed on the surface of each ground core through the shell layer formation process. Both the first resin particles (more specifically, resin particle substantially composed of styrene-acrylic acid-based resin) and the third resin particles (more specifically, resin particles substantially composed of a polymer of a (meth)acryloyl group-containing quaternary ammonium compound and two alkyl (meth)acrylates) of each of the toners according to Examples 1 to 18 were fusion bonded to the polyester resin on the surfaces of the toner cores. Furthermore, as a result of the mixing process using the UM mixer, the second resin particles thereof on the first resin particles adhered to the first resin particles mainly by Van der Waals forces, and the second resin particles on the third resin particles adhered to the third resin particles mainly by Van der Waals forces.

As shown in Table 3, the toners according to Examples 1 to 18 had good results in all the high-temperature preservability evaluation, the image density retention evaluation, and the low-temperature fixability evaluation. Each of the toners according to Examples 1 to 18 was excellent in high-temperature preservability and low-temperature fixability, and was capable of continuously forming images each having almost the same image density in a stable manner when used in continuous printing.

Each of the toners TA-4 and TB-1 (the toners according to Comparative Examples 1 and 4) was inferior in image density retention to the toners according to Examples 1 to 18. The reason for the above is thought to be that the amount of the second resin particles in each of the toners TA-4 and TB-1 was so small that each of the toners had insufficient developing properties and transferability.

Each of the toners TA-6 and TB-5 (the toners according to Comparative Examples 2 and 5) was inferior in low-temperature fixability to the toners according to Examples 1 to 18. The reason for the above is thought to be that the amount of the second resin particles (the resin particles having a higher Tg) in each of the toners TA-6 and TB-5 was too large.

The toner TA-7 (the toner according to Comparative Example 3) was inferior in low-temperature fixability to the toners according to Examples 1 to 18. The reason for the above is thought to be that the toner TA-7 had a too high first shell coverage.

Each of the toners TC-1, TC-2, TF-1, and TF-2 (the toners according to Comparative Examples 6, 7, 10, and 11) was inferior in image density retention to the toners according to Examples 1 to 18. The reason for the above is thought to be that the second resin particles in each of the toners TC-1, TC-2, TF-1, and TF-2 had so large number average primary particle diameter that the second resin particles were easily detachable from the toner particles.

Each of the toners TC-4 and TF-4 (the toners according to Comparative Examples 8 and 12) was inferior in image density retention to the toners according to Examples 1 to 18. The reason for the above is thought to be that the second resin particles in each of the toners TC-4 and TF-4 had so low Tg that the second resin particles were easily deformable.

The toner TD-5 (the toner according to Comparative Example 9) was inferior in high-temperature preservability to the toners according to Examples 1 to 18. The reason for the above is thought to be that the amount of the second resin particles was too small in the toner TD-5.

The toner TF-5 (the toner according to Comparative Example 13) was inferior in image density retention to the toners according to Examples 1 to 18. The reason for the above is thought to be that the second resin particles in the toner TF-5 had so small number average primary particle diameter that the second resin particles were easily embedded in the surfaces of the toner particles.

The toner TG-1 (the toner according to Comparative Example 14) was inferior in high-temperature preservability to the toners according to Examples 1 to 18. The reason for the above is thought to be that the toner TG-1 had a too low first shell coverage.

The toner TG-4 (the toner according to Comparative Example 15) was inferior in low-temperature fixability to the toners according to Examples 1 to 18. The reason for the above is thought to be that the toner TG-4 had a too high first shell coverage.

The toner TH-1 (the toner according to Comparative Example 16) was inferior in low-temperature fixability to the toners according to Examples 1 to 18. The reason for the above is thought to be that the first resin particles in the toner TH-1 had a too high Tg.

Each of the toners TH-2 and TH-3 (the toners according to Comparative Examples 17 and 18) was inferior in low-temperature fixability to the toners according to Examples 1 to 18. The reason for the above is thought to be that the first resin particles in each of the toners TH-2 and TH-3 had a too large number average primary particle diameter.

INDUSTRIAL APPLICABILITY

The electrostatic latent image developing toner according to the present invention can for example be used for forming images in copiers, printers, or multifunction peripherals.

The invention claimed is:

1. An electrostatic latent image developing toner comprising a plurality of toner particles each including a core containing a polyester resin and a shell layer disposed over a surface of the core, wherein the shell layer includes:

a plurality of first resin particles having a number average primary particle diameter of at least 30 nm and less than 70 nm and a glass transition point of less than 80° C.; and a plurality of second resin particles having a number average primary particle diameter of at least 70 nm and no greater than 200 nm and a glass transition point of at least 80° C., a percentage of an area of the core that is covered with the first resin particles relative to a surface area of the core is at least 40% and no greater than 80%, a ratio of a total mass of the plurality of second resin particles to a total mass of the plurality of first resin particles is at least 0.5 and no greater than 2.0, the first resin particles contain no charge control agent, the second resin particles contain no charge control agent, the shell layer further contains a plurality of third resin particles containing a charge control agent, the shell layer includes a first resin layer and a second resin layer, the first resin layer including the plurality of first resin particles and the plurality of third resin particles, the second resin layer including the plurality of second resin particles, and the first resin layer and the second resin layer are stacked in the following order: the core, the first resin layer, and the second resin layer.

2. The electrostatic latent image developing toner according to claim 1, wherein the first resin particles are substantially composed of a styrene-acrylic acid-based resin, the second resin particles are substantially composed of a styrene-acrylic acid-based resin, and the third resin particles are substantially composed of a resin having a repeating unit derived from a (meth) acryloyl group-containing quaternary ammonium compound.

3. The electrostatic latent image developing toner according to claim 1, wherein the core is a ground core, the polyester resin contained in the core has a glass transition point of no greater than 50° C., the first resin particles have a glass transition point of at least 65° C., the third resin particles have a glass transition point of at least 65° C., the first resin particles are fusion bonded to the polyester resin on the surface of the core, the third resin particles are fusion bonded to the polyester resin on the surface of the core, the second resin particles on the first resin particles adhere to the first resin particles mainly by Van der Waals forces, and the second resin particles on the third resin particles adhere to the third resin particles mainly by Van der Waals forces.

4. The electrostatic latent image developing toner according to claim 1, wherein the toner particles each further include inorganic particles serving as an external additive.

* * * * *